US005284099A

United States Patent [19]

Cohen

[11] Patent Number: 5,284,099

[45] Date of Patent: Feb. 8, 1994

[54] TABLE MAT

[76] Inventor: Paul J. Cohen, 1655 Flatbush Ave., - Apt. B709, Brooklyn, N.Y. 11210

[21] Appl. No.: 711,151

[22] Filed: Jun. 6, 1991

[51] Int. Cl.[5] ..... A47B 13/08

[52] U.S. Cl. ..... 108/90

[58] Field of Search ..... 108/90; 150/154, 158

[56] References Cited

U.S. PATENT DOCUMENTS

| | | | |
|---|---|---|---|
| 2,954,635 | 10/1960 | Stotter | 108/90 X |
| 3,939,976 | 2/1976 | VanIseghem, Jr. | 100/90 X |
| 4,777,992 | 10/1988 | Olger | 108/90 |
| 5,069,554 | 12/1991 | Bonnett . | |

FOREIGN PATENT DOCUMENTS

| | | | |
|---|---|---|---|
| 3500928 | 7/1986 | Fed. Rep. of Germany | 292/219 |
| 564236 | 6/1960 | France | 108/90 |
| 2408330 | 6/1979 | France | 108/90 |
| 25616 | of 1904 | United Kingdom | 108/90 |
| 24315 | of 1915 | United Kingdom | 108/90 |

*Primary Examiner*—Jose V. Chen

*Attorney, Agent, or Firm*—Francis C. Hand

[57] ABSTRACT

A table mat of rectangular construction is provided with at least one pair of parallel lines of perforations, scores or crease to permit end areas of the mat to be folded downwardly to drape over the ends of a table. The mat is of relatively heavy paper while being grease resistant and stain resistant. Two mats may be used to cover a table and to provide drapes to four sides of the table.

20 Claims, 1 Drawing Sheet

Fig. 1.
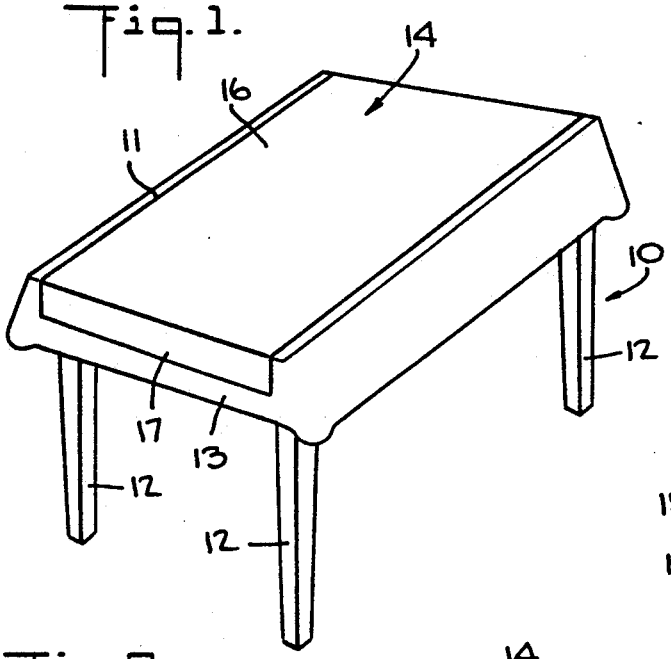
Fig. 2.
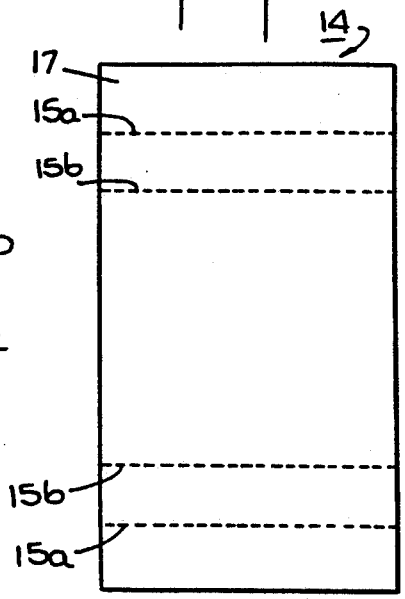
Fig. 3.
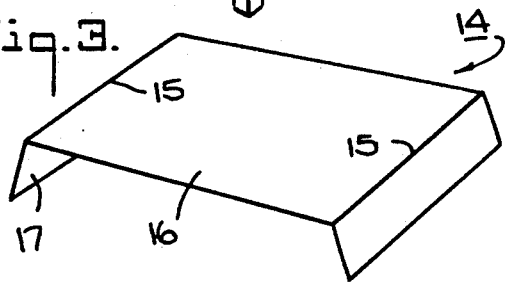
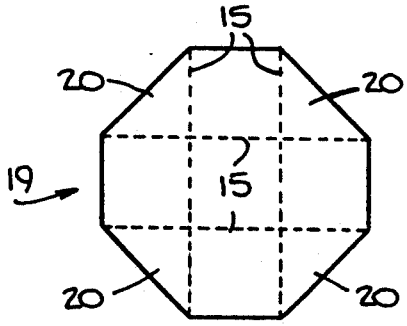
Fig. 6.
Fig. 4.
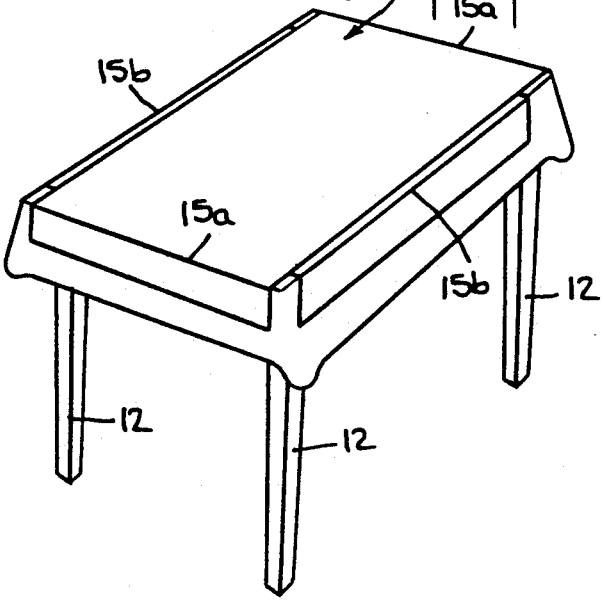
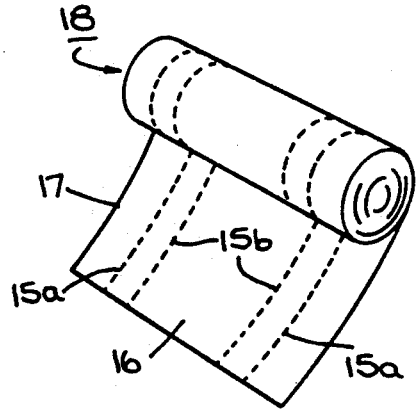
Fig. 5.

TABLE MAT

This invention relates to a table mat.

As is known, place mats have been used, for example, in restaurants and similar establishments, in order to protect an underlying table surface or an underlying tablecloth from stains and the like. Generally, the mats have been of a type which are sized so as to be placed at an individual place setting with tableware disposed thereon. However, one problem which arises with such an individualized place mat is that spills can occur directly onto the exposed surfaces of the table or tablecloth.

Accordingly, it is an object of this invention to provide a table mat which can be readily disposed over a table surface or a tablecloth on a table surface in order to protect the underlying table or tablecloth.

It is another object of the invention to provide a table mat which can be readily disposed over a table.

It is another object of the invention to provide a table mat of relatively inexpensive construction.

It is another object of the invention to provide a table mat of aesthetically pleasing appearance for covering a table.

Briefly, the invention provides a table mat of polygonal shape having at least one pair of parallel lines of perforations or creases or scores defining a central area for disposition over a table surface and a pair of end areas for folding about the lines of perforation or creases or scores in order to depend downwardly from two sides of a table.

The table mat may be used to cover over a table surface or to cover over a tablecloth disposed over a table surface.

The table mat may also be provided with two pairs of parallel lines of perforations on each side to permit a selective folding over of an end area so as to accommodate different widths of table surfaces.

In one embodiment, the table mat is of rectangular construction so as to be used with a rectangular, or a square table. In this embodiment, the end areas of the mat may be folded about the respective line of perforation so as to depend vertically at two ends of the table.

In another embodiment, the table mat may be made of octagonal shape so as to be adapted for use with a circular or oval table having drop leaves. In this respect, the octagonal table mat is sized so that a round or oval table can be disposed within the contour of the mat, for example in the form an inscribed circle within the octagonal shape of the mat. Where such a table has a pair of drop leaves at opposite sides, for example, being hinged to pivot downwardly, the central area of the mat may remain in place over the remaining oval surface of the table. The mat may then folded about the perforations or the like so as to drape over the dropped sides of the table. Should the table have four drop leaves, then the table mat may be provided with two pairs of parallel lines of perforations or the like which are mutually disposed in perpendicular relation so that four sides of the mat can be folded downwardly to drape over the four sides of the table. The remaining central area of the mat would remain over the rectangular or square table surface remaining.

Pairs of rectangular table mats may also be used on a rectangular table so as to provide a draped appearance on four sides of the table. In this respect, the table mats would be disposed over the table in turned relation to each other so as to drape over the four sides of the table.

The table mat may be supplied in individual sheets or may be supplied from a roll. In the latter case, the length of sheet removed from the roll can be selected at will.

These and other objects and advantages of the invention will become more apparent from the following detailed description taken in conjunction with the accompanying drawing wherein:

FIG. 1 illustrates a perspective view of a mat disposed over a table having a tablecloth thereon in accordance with the invention;

FIG. 2 illustrates a plan view of a table mat constructed in accordance with the invention;

FIG. 3 illustrates a perspective view of a table mat having end areas folded downwardly in accordance with the invention;

FIG. 4 illustrates a view similar to FIG. 1 wherein two table mats are disposed over a table;

FIG. 5 illustrates a roll of paper for supplying a multiplicity of table mats in accordance with the invention; and FIG. 6 illustrates a plan view of a table mat of octagonal construction in accordance with the invention.

Referring to FIG. 1, the table 10 is of conventional construction having a horizontally disposed surface 11 and a plurality of legs, for example, four legs, depending from the corners of the table surface in order to support the table surface 11. Alternatively, any other suitable leg arrangement can be used for supporting the table surface, for example, a pedestal type leg. In addition, the table 10 is covered over by a tablecloth 13 of conventional type.

In accordance with the invention, a table mat 14 is provided over the table cloth 13 in order to protect the table cloth 13 against spills and strains.

Referring to FIG. 2, the table mat 14 is of rectangular shape having at least one pair of parallel lines of perforations 15 defining a central area 16 for disposition over the table surface 11 (see FIG. 1) and a pair of end areas 17 for folding about the lines of perforations 15 in order to depend downwardly from two sides of the table 10 (see FIGS. 1 and 3).

As illustrated, the mat 14 is provided with two pairs of parallel lines of perforations 15 for selective folding of the end areas 17 to provide a different width for the central area 16.

Alternatively, creases or score lines or the like may be used in place of the perforation. Also, printed fold lines (not shown) may be provided on, along or adjacent to the perforations, creases or score lines by means of a suitable printing die, wheel or plate.

The table mat 14 may have any suitable dimensions. For purposes of example, the table mat 14 may have an overall width of 24 inches and an overall length of 30 inches . In this case, the central area may have dimensions of 24 inches by 24 inches for mounting over a square table while the end areas 17 each have dimensions of 3 inches by 24 inches so as to provide a 3 inch drape. Where two lines of perforations 15 are used, the lines may be spaced 2 inches apart so as to provide for different dimensions of central area and end areas.

The size of the table mat is not critical and may be 24 inches by 28 inches, 34 inches by 34 inches and the like.

Alternatively, the table mat 14 may be used without draping of the end edges 17 over the sides of a table.

Referring to FIG. 3, the mat 14 may be prefolded so as to have the end areas 17 disposed in a downwardly directed manner relative to the central area 16. This can be carried out prior to disposition of the table mat 14 over a tablecloth covered table so as to facilitate disposition of the table mat over the table.

The table mat 14 is made of a heavy paper so as to resist tearing. In contrast to napkin-like paper which weighs approximately 25 pounds per 500 sheet ream and generally characterized as having a weight in the range of from 15 to 30 pound paper, the table mat 14 is made of a paper having a weight in the range of from 50 to 60 pound weight. In this respect, a 60 pound paper is one which weighs 120 pounds per million square inches. In this respect, It is to be noted that the table mat 14 may be made of a paper having a weight down to approximately 40 pound weight. For example, the table mat may have a weight per ream in a range of from 35 to 60 pounds, wherein the ream is made up of 500 sheets of paper 25 inches by 38 inches.

The table mat 14 is also made to be water resistant and grease resistant. In this respect, the chemical composition of the paper is such as to provide for water resistance and grease resistance.

Referring to FIG. 4, wherein like reference characters indicate like parts as above, two mats 14 may be disposed over a tablecloth covered table 10. In this case, the two mats 14 would be turned 90 degrees relative to each other so that the end areas 17 of the respective mats 14 drape over the four ends of the table 10.

As indicated, the mats 14 are provided on an individual basis. However, the mats may also be supplied from a roll 18. In this case, a length of the mat can be drawn off the roll and then cut at a suitable point to match with the table to be covered. In this case, the web of paper may have transverse perforations (not shown) so as to facilitate tearing off of an individual mat from the roll 18.

While the table mat is indicated as being used on a rectangular table, the mats may also be used on tables of circular shape. In this case, the mats would not have the end areas draped over the edges of the table but rather, the mats would tend to lay flat on the table while exposing small areas of the underlying table or tablecloth.

For example, referring to FIG. 6, the table mat 19 may be formed of octagonal shape for use on a circular table, oval shaped table or rectangular shaped table. As indicated, the table mat 19 is provided with two pairs of parallel perforations 15 disposed in perpendicular relation to each other. As indicated, each pair of lines of perforations 15 forms a rectangular section.

The octagonal shaped mat 19 may be made from a square piece of paper with the four corners cut off at an angle so as to form the eight sided polygon. When in use, the table mat 19 can be placed directly onto a table of circular shape such that the circular shape of the table forms an inscribed circle within the octagonal contour of the mat 19. Should the circular table have drop leaves on two or four sides, the respective opposed pairs of leaves can be dropped into a vertical position, At this time, the mat may be folded about the respective pair of lines of perforations 15 so as to drape over the dropped leaves of the table. For example, if two leaves are dropped, the mat 19 may be folded about one pair of perforations 15 so as to have two sides of the mat draped over the dropped leaves. The remaining central section would then cover over the remaining surface of the table. In the embodiment where four leaves are dropped, the mat 19 would be folded about both sets of lines of perforations 15 so as to drape over the four dropped leaves of the table. The corner portions 20 of the mat 19 may be provided with creases or the like in order to permit folding in a draped manner when the mat 19 is folded about the dropped leaves of the table.

The table mat may be made of other polygonal shape than that illustrated in the drawings, for example, the mat may be made of hexagonal shape.

The table mats may also be provided with printed indicia to show where to fold the mat. Further, the table mats may also be provided with advertising media or other decorative printing so as to enhance the aesthetic appearance of the mat. For example, the mats may be provided with advertising media pertinent to the establishment in which the mats are used.

It is also noted that the mats may be employed to cover a table where there is a desire to protect the table against damage, for example, caused by spills. For example, the mats may be used on picnic tables, outdoor tables, and the like.

What is claimed is:

1. A paper table mat of polygonal shape having at least one pair of parallel lines of perforations defining a central area for disposition over a table surface and a pair of end areas for folding about said lines of perforations to depend downwardly from two sides of a table, each said end area being of smaller size than said central area.

2. A table mat as set forth in claim 1 having two pairs of said parallel lines of perforations for selective folding of a pair of end areas of different widths relative to said central area, each said pair of parallel lines of perforations being disposed on an opposite side of said central area from the other of said pair of parallel lines of perforations.

3. A table mat as set forth in claim 2 wherein said mat is rectangular and said central area has dimensions of twenty-four inches by twenty-four inches.

4. A table mat as set forth in claim 3 wherein each end area has dimensions of three inches by twenty-four inches.

5. A table mat as set forth in claim 1 having a weight of 120 pounds per million square inches.

6. A table mat as set forth in claim 1 characterized in having a chemical composition providing water resistance and grease-resistance to said sections.

7. A table mat as set forth in claim 1 characterized in having a weight in a range of from 50 to 60 pounds.

8. A table mat as set forth in claim 1 characterized in having a weight of at least 40 pounds.

9. A table mat as set forth in claim 1 wherein said central area has advertising media thereon.

10. A table mat as set forth in claim 1 of octagonal shape having a first pair of parallel lines of perforations defining a rectangular area therebetween and a second pair of parallel lines of perforations perpendicular to said first line of perforations and defining a rectangular area therebetween.

11. A roll of paper for forming a plurality of table mats, said roll having at least a pair of parallel lines of longitudinally disposed perforations defining a central area therebetween for disposition over a table surface and a pair of parallel end areas for folding about said lines of perforations to depend downwardly from two sides of a table, each said end area being of smaller size than said central area said paper being water-resistant and grease-resistant with a basis weight of at least 40 pounds.

12. A roll of paper as set forth in claim 11 having two pairs of said parallel lines of perforations for selective folding of said end areas to provide a different width for said central area, each said pair of parallel lines of perforations being disposed on an opposite side of said central area from the other of said pair of parallel lines and perforations.

13. In combination, a table having a polygonal surface;

a tablecloth disposed over said surface of said table; and paper water resistant and grease resistant table mat disposed on said tablecloth, said mat having a pair of parallel lines of perforations defining a rectangular area disposed over said tablecloth and a pair of end areas depending downwardly from said rectangular area over opposite sides of said table.

14. The combination as set forth in claim 13 wherein said mat has two pairs of said parallel lines of perforations for selective folding of a pair of end areas of different width relative to said rectangular area, each said pair of parallel lines of perforations being disposed on an opposite side of said rectangular area from the other of said pair of parallel lines and perforations.

15. The combination as set forth in claim 13 wherein said mat is a paper having a weight of from 50 pounds to 60 pounds.

16. The combination as set forth in claim 13 wherein said mat has advertising media thereon.

17. The combination as set forth in claim 13 wherein said mat is of rectangular shape and which further comprise a second table mat of rectangular shape disposed over said one table mat with a pair of end areas depending downwardly from a central area thereof over two other sides of said table.

18. The combination as set forth in claim 13 wherein said table has a circular surface and said table mat has an octagonal shape.

19. The combination as set forth in claim 18 wherein said table has a pair of drop leaves on opposite sides thereof and said end areas of said table mat are disposed over said drop leaves.

20. A paper table mat of polygonal shape having at least one pair of parallel lines of perforations defining a central area for disposition over a table surface and a pair of end areas for folding about said lines of perforations to depend downwardly from two sides of a table, said mat having a chemical composition providing water resistance and grease resistance to said sections.

* * * * *

UNITED STATES PATENT AND TRADEMARK OFFICE

CERTIFICATE OF CORRECTION

PATENT NO. : 5,284,099

DATED : February 8, 1994

INVENTOR(S) : Paul Cohen

It is certified that error appears in the above-identified patent and that said Letters Patent is hereby corrected as shown below:

Column 2, line 51 change "perforation" to -perforations-;

Column 5, line 14 change "paper...table mat" to -at least one water resistant and grease resistant paper table mat- Signed and Sealed this Fourteenth Day of June, 1994

*Attest:*

*Attesting Officer*

BRUCE LEHMAN

*Commissioner of Patents and Trademarks*